US010961645B2

(12) United States Patent
Marcangelo

(10) Patent No.: US 10,961,645 B2
(45) Date of Patent: Mar. 30, 2021

(54) SEWING MACHINE WITH READILY ADJUSTABLE STEPPING HEIGHT

(71) Applicant: L&P Property Management Company, South Gate, CA (US)

(72) Inventor: Steven Marcangelo, Londonderry, NH (US)

(73) Assignee: L&P Property Management Company, South Gate, CA (US)

( * ) Notice: Subject to any disclaimer, the term of this patent is extended or adjusted under 35 U.S.C. 154(b) by 110 days.

(21) Appl. No.: 16/409,117

(22) Filed: May 10, 2019

(65) Prior Publication Data

US 2020/0354871 A1 Nov. 12, 2020

(51) Int. Cl.
*D05B 29/02* (2006.01)
*D05C 9/20* (2006.01)

(52) U.S. Cl.
CPC ..... *D05B 29/02* (2013.01); *D05C 9/20* (2013.01)

(58) Field of Classification Search
CPC .. D05B 29/00–12; D05B 27/00; D05B 27/04; D05B 27/06; D05B 27/08; D05C 9/20; D05C 9/00; D05C 9/02
See application file for complete search history.

(56) References Cited

U.S. PATENT DOCUMENTS 1,512,582 A * 10/1924 De Voe ..... D05B 27/06 112/320
2,119,316 A * 5/1938 Clayton ..... D05B 27/04 112/320
2,419,494 A 4/1947 Knaus
2,430,440 A * 11/1947 Zeier ..... D05B 27/04 112/237
2,470,759 A * 5/1949 Clayton ..... D05B 27/04 112/320
3,437,062 A 4/1969 Hacklander
(Continued)

FOREIGN PATENT DOCUMENTS

DE 102004030376 B3 9/2005
JP 362152498 7/1987
JP H09220389 A 8/1997

OTHER PUBLICATIONS

U.S. Patent and Trademark Office; Search Report in related International Patent Application No. PCT/US2020/031423 dated Aug. 3, 2020; 9 pages.

*Primary Examiner* — Ismael Izaguirre
(74) *Attorney, Agent, or Firm* — Wood Herron & Evans LLP

(57) ABSTRACT

A sewing machine comprises a crank shaft, a first drive shaft, a second drive shaft, a needle assembly, a presser foot, and an upper walking foot. A first crank arm assembly is connected to the crank shaft to the first drive shaft. A first linkage assembly is connected to the first drive shaft to the needle assembly. A second crank arm assembly is connected to the first drive shaft to the second drive shaft. A second linkage assembly is connected to the second drive shaft to the presser foot and the upper walking foot. The second linkage assembly is configured to cause out-of-phase reciprocatory movement of the presser foot and the upper walking foot. The second crank arm assembly has a variable length that is selectably adjustable by an operator to yield at least first and second different stepping heights of the upper walking foot.

20 Claims, 9 Drawing Sheets

(56) References Cited

U.S. PATENT DOCUMENTS

| | | | | | |
|---|---|---|---|---|---|
| 4,285,289 | A | | 8/1981 | Bolldorf et al. | |
| 4,323,020 | A | | 4/1982 | Thompson | |
| 4,449,464 | A | | 5/1984 | Porter | |
| 4,476,796 | A | * | 10/1984 | Vollmar ..... | D05B 27/04<br>112/320 |
| 4,503,794 | A | | 3/1985 | Ishihara et al. | |
| 4,706,587 | A | | 11/1987 | Shiomi | |
| 5,309,854 | A | | 5/1994 | Mulcahey et al. | |
| 5,678,502 | A | | 10/1997 | Mulcahey et al. | |
| 6,164,225 | A | | 12/2000 | Murata et al. | |
| 6,170,414 | B1 | | 1/2001 | Kaetterhenry et al. | |
| 7,360,497 | B2 | | 4/2008 | Marcangelo et al. | |
| 8,387,547 | B2 | | 3/2013 | Bardh et al. | |
| 2005/0039658 | A1 | | 2/2005 | Marcangelo et al. | |
| 2008/0257242 | A1 | | 10/2008 | Park | |

* cited by examiner

SEWING MACHINE WITH READILY ADJUSTABLE STEPPING HEIGHT

RELATED APPLICATIONS

N/A.

FIELD OF THE INVENTION

This invention relates generally to sewing machines, and more particularly to industrial sewing machines having the capability of sewing relatively thinner materials and relatively thicker materials.

BACKGROUND OF THE INVENTION

Industrial sewing machines have long been used for sewing together relatively thinner materials and relatively thicker materials. One example of a relatively thicker material is a mattress panel. Sewing machines used for sewing such thicker materials must be adapted to provide adequate vertical clearance for the material to fit through the throat of the machine. The throat plate or needle plate, the plate upon which the material rests as it is sewed, defines the bottom plane of the space in which the material must fit in the throat of the machine. The thickness of the material which can be sewn by the machine is dictated by the clearance between the throat plate and the needle, presser foot, and upper walking foot or top feed dog when at their upper travel limits.

One type of industrial sewing machine, which is particularly adapted for sewing thicker materials, utilizes an upper walking foot and a lower feed dog (sometimes referred to as "top and bottom feed"), and is configured to impart out-of-phase reciprocatory movement of the presser foot and walking foot. Such a sewing machine is shown in U.S. Pat. Nos. 4,449,464 and 5,309,854. In this type of sewing machine, the upper walking foot travels in a more or less elliptical motion during sewing, and thus has a horizontal motion component (stepping length or feed length) and a vertical motion component (stepping height). While current such sewing machines may have a means for readily adjusting the feed length of the upper walking foot, adjustment of the stepping height of the upper walking foot is typically much more cumbersome and time consuming. Examples of such machines are the Pegasus EXT3200 Series and EXT5200 Series of industrial sewing machines. These machines have a combination knob and lever to adjust the feed length. However, to adjust the stepping height, a qualified technician must turn the machine pulley, loosen certain screws, manipulate the top feed dog and link, set the height of the top feed dog for the desired material thickness, and once at the correct height, retighten the screws.

It is thus desirable to provide a sewing machine of the type that utilizes an upper walking foot and a lower feed dog and that imparts out-of-phase reciprocatory movement of the presser foot and walking foot, with a means for readily adjusting the stepping height in order to more quickly and easily configure the machine for sewing thicker materials.

SUMMARY OF THE INVENTION

In one aspect, a sewing machine comprises a crank shaft, a first drive shaft, a second drive shaft, a needle assembly, a presser foot, and an upper walking foot. A first crank arm assembly is connected to the crank shaft to the first drive shaft. A first linkage assembly is connected to the first drive shaft to the needle assembly. A second crank arm assembly is connected to the first drive shaft to the second drive shaft. A second linkage assembly is connected to the second drive shaft to the presser foot and the upper walking foot. The second linkage assembly is configured to cause out-of-phase reciprocatory movement of the presser foot and the upper walking foot. The second crank arm assembly has a variable length that is selectably adjustable by an operator to yield at least first and second different stepping heights of the upper walking foot.

The variable length second crank arm can also yield at least first and second different uppermost travel limits of the presser foot.

The first crank arm assembly can include a first crank arm and a first crank lever. The first crank arm can be pivoted at a first end to the crank shaft. The first crank lever can be fixedly secured at a first end to the first drive shaft. The first crank arm and the first crank lever can be pivotally connected at respective second ends.

The second crank arm assembly can include a second crank arm and a second crank lever. The second crank arm can be pivoted at a first end to the first crank lever. The second crank lever can be fixedly secured at a first end to the second drive shaft. The second crank arm and the second crank lever can be translationally and pivotally connected at respective second ends.

One of the second crank arm and the second crank lever can include a pin and the other of the second crank arm and the second crank lever can include an elongated slot. The pin can ride in the slot. The position of the pin along a length of the slot can be selectably adjustable by an operator. Preferably the second crank arm includes the pin and the second crank lever includes the slot.

The sewing machine can further include a lead screw selectably rotatable by an operator and configured to translate the pin along the length of the slot providing a low stepping height of the walking foot, a high stepping height of the walking foot, and a plurality of stepping heights between the low stepping height and the high stepping height. In other words, the lead screw provides the capability having essentially continuous or infinite adjustability of the stepping height between the low stepping height and the high stepping height.

The lead screw can include a knob that is manually rotatable by an operator to rotate the lead screw. The lead screw can include a block that translates generally horizontally in response to rotation of the lead screw. An end of the pin can ride in the block. The second linkage assembly, the first crank arm assembly, and the second crank arm assembly can be configured to cause the end of the pin to translate generally vertically in the block in response to the block translating generally horizontally. In doing so, the distance between a center line of the second drive shaft and a center line of the pin to can be selectably varied. The block can include a generally vertically extending channel. The end of the pin can have a cross-section that mates with a cross-section of the channel.

Alternatively, the sewing machine can include a pneumatic cylinder actuatable by an operator and configured to translate the pin along the length of the slot providing a low stepping height of the walking foot and a high stepping height of the walking foot. Similar to the lead screw embodiment, the pneumatic cylinder can include the aforementioned block that translates generally horizontally in response to translation of a piston rod of the pneumatic cylinder.

In another aspect, a sewing machine comprises a crank shaft, a drive shaft, a needle assembly, a presser foot, and an upper walking foot. A crank arm connects the crank shaft and to the drive shaft. A linkage assembly connects the drive shaft to the needle assembly, the presser foot, and the upper walking foot. The linkage assembly is configured to cause out-of-phase reciprocatory movement of the presser foot and the upper walking foot. An adjustment mechanism is selectably adjustable by an operator that varies a center line to center line distance between two pivot axes of the linkage assembly to yield at least first and second different stepping heights of the upper walking foot.

The first and second links of the linkage mechanism can be translationally and pivotally connected at respective ends to provide the variable center line to center line distance between the two pivot axes of the linkage assembly. One of the first and second links can include a pin and the other of the first and second links can include an elongated slot. The pin can ride in the slot. A position of the pin along a length of the slot selectably can be adjustable by an operator.

The sewing machine can include a lead screw selectably rotatable by an operator and configured to translate the pin along the length of the slot providing a low stepping height of the walking foot, a high stepping height of the walking foot, and a plurality of stepping heights between the low stepping height and the high stepping height.

The lead screw can include a knob that is manually rotatable by an operator to rotate the lead screw. The lead screw can include a block that translates generally horizontally in response to rotation of the lead screw. An end of the pin can ride in the block. The linkage assembly can be configured to cause the end of the pin to translate generally vertically in the block in response to the block translating generally horizontally. In doing so, the center line to center line distance between the two pivot axes of the linkage assembly can be selectably varied. The block can include a generally vertically extending channel. The end of the pin can have a cross-section that mates with a cross-section of the channel.

Alternatively, the sewing machine can include a pneumatic cylinder actuatable by an operator and configured to translate the pin along the length of the slot providing a low stepping height of the walking foot and a high stepping height of the walking foot. Similar to the lead screw embodiment, the pneumatic cylinder can include the aforementioned block that translates generally horizontally in response to translation of a piston rod of the pneumatic cylinder.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
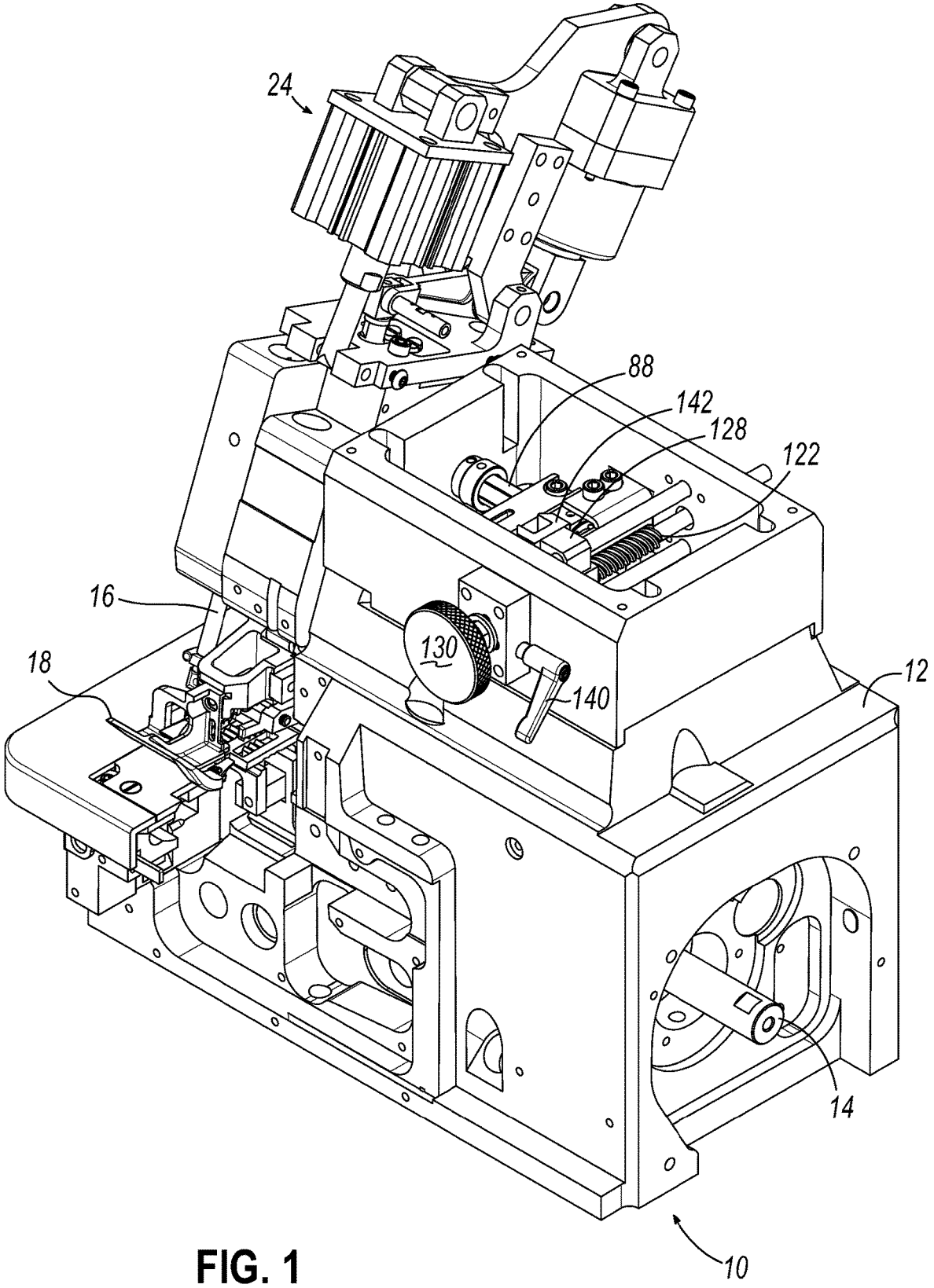
FIG. 1 is a front, top, left perspective view of a sewing machine embodying the principles of the present invention.
Figure 2:
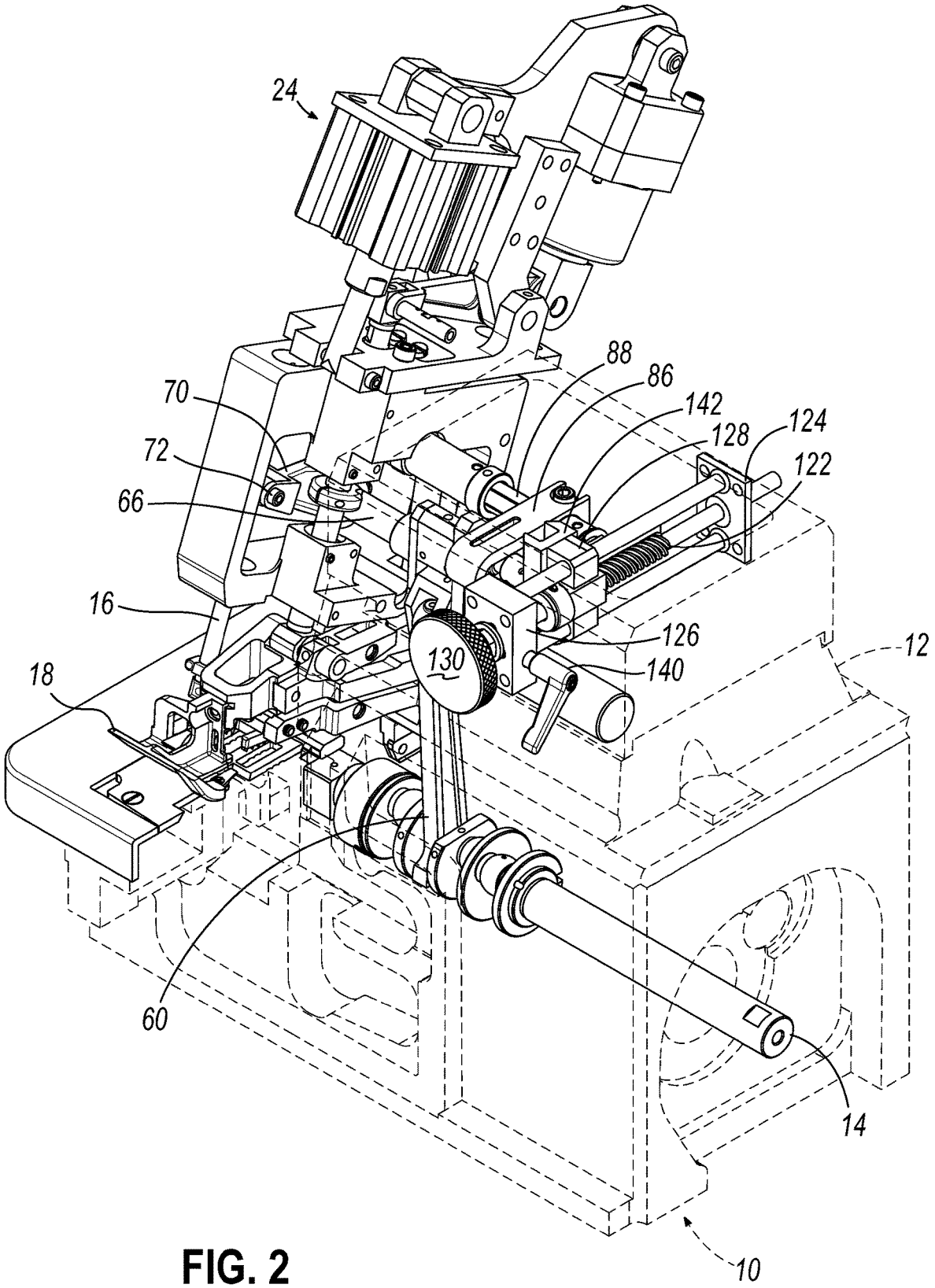
FIG. 2 is a view similar to FIG. 1 with portions of the sewing machine frame in phantom for clarity.
Figure 3A:
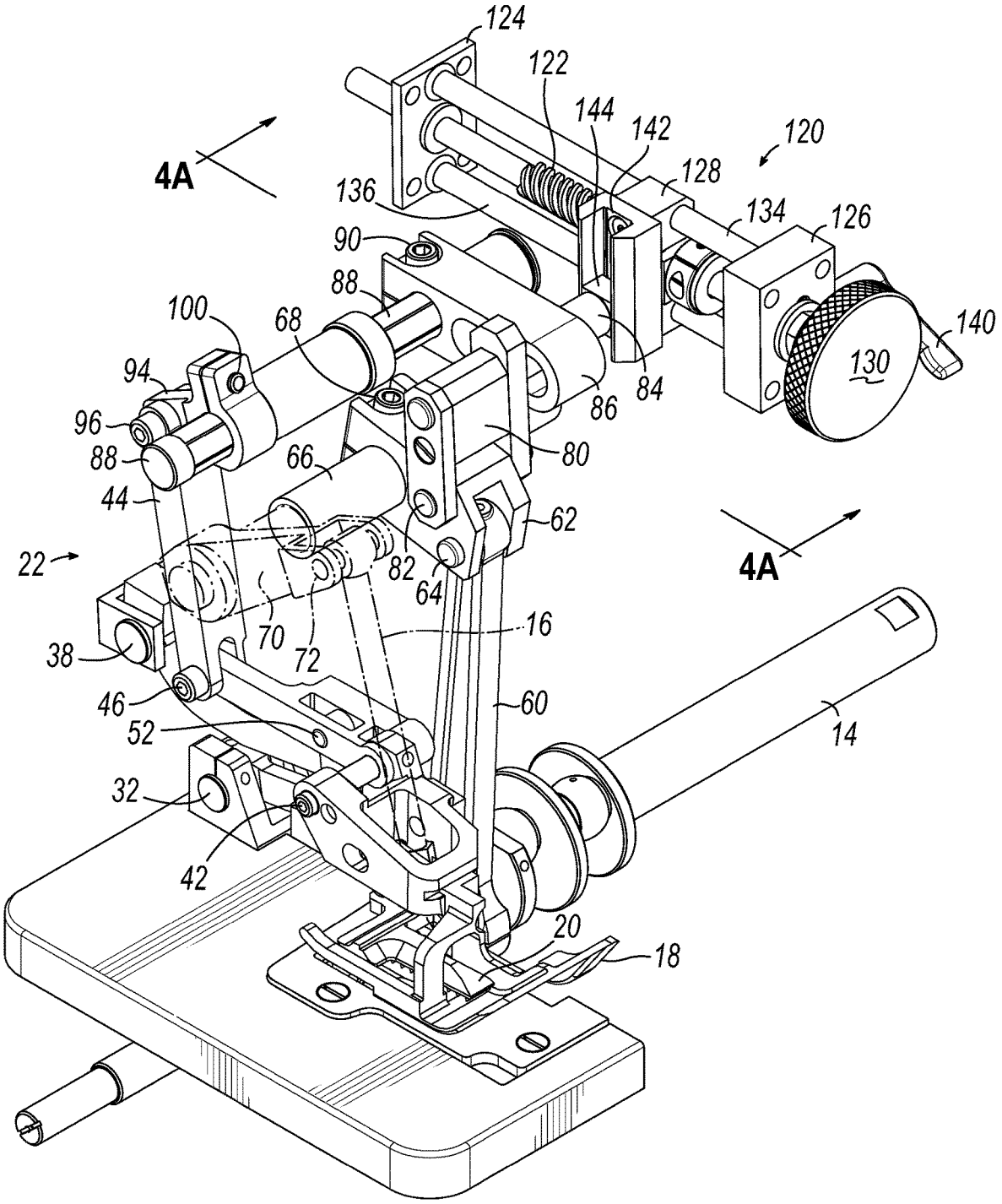
FIG. 3A is a front, top, right perspective view of the sewing machine of FIGS. 1 and 2 illustrating the needle assembly, presser foot, linkage assembly, and adjustment mechanism, with the presser foot in the lowermost position.
Figure 3B:
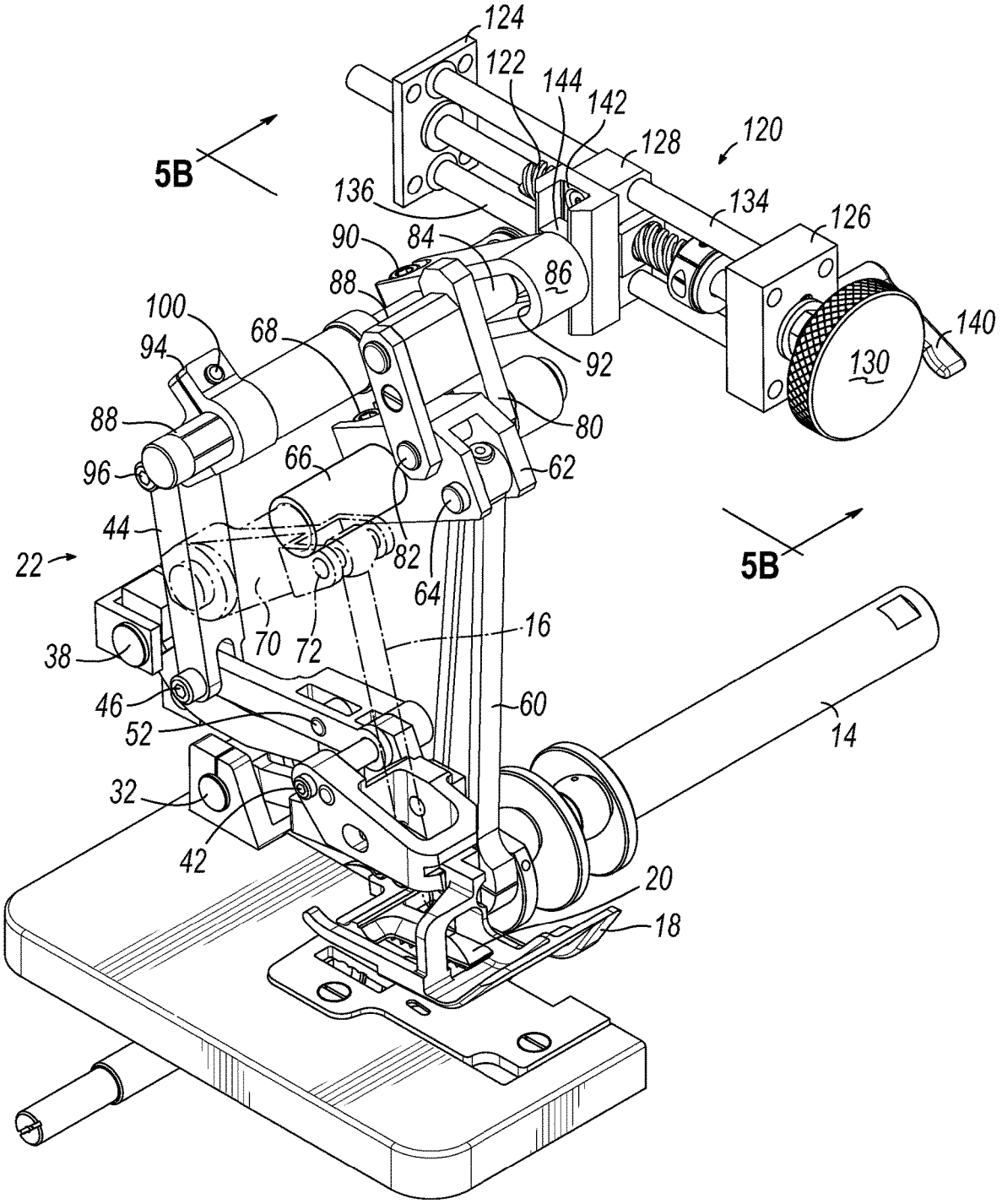
FIG. 3B is a view similar to FIG. 3A but with the presser foot in the uppermost position.

Referring to first to FIGS. 1-5B, there is illustrated a sewing machine 10 embodying the principles of the present invention. The sewing machine 10 includes, generally, a machine frame 12, a crank shaft 14, a needle assembly 16, a presser foot 18, a walking foot 20, and a linkage assembly 22. The machine 10 may also include a presser foot biasing mechanism 24. Presser foot biasing mechanism 24 may preferably be of the type shown and described in U.S. Pat. No. 7,360,497, hereby incorporated by reference herein as if fully set forth in its entirety.

Referring now to FIGS. 3A-5B, the walking foot 20 is supported at the front end of an arm 30. The opposite rear end of the arm 30 is pivotally connected at 32 to the reciprocating drive system for the lower feed dog (not shown in detail). The presser foot 18 is supported at the front end of an arm 34. The opposite rear end of the arm 34 is pivotally connected to a standard 36 as at 38. A link 40 is pivotally connected at its front end to the presser foot 18 at 42 and is pivotally connected at its opposite rear end to a lower end of link 44 at 46. The walking foot arm 30 and link 40 are pivotally connected by a link 50 at 52 and 54.

A crank arm 60 is pivotally connected at its lower end to crank shaft 14 and is pivotally connected at its upper end to a front end of a crank lever 62 at 64. Crank lever 62 is fixedly connected at its opposite rear end to a drive shaft 66 as by a lock screw 68. A link or lever 70 is pivotally connected at its front end to an upper end of the needle assembly 16 at 72 and is fixedly connected at its opposite rear end to the drive shaft 66 as by a lock screw (not shown).

A second crank arm 80 is pivotally connected at its lower end to crank lever 62 at 82. The upper end of the crank arm 80 carries a pin 84. A second crank lever 86 has its rear end fixedly connected to a second drive shaft 88 as by a lock screw 90. The opposite front end of the second crank lever 86 has an elongated slot 92 therein. Pin 84 rides in slot 92.

The upper end of link 44 is pivotally connected to the rear end of a link or lever 94 at 96. The opposite front end of the link or lever 94 is fixedly connected to the second drive shaft as by a lock screw 100.

The linkage assembly 22 is configured to cause out-of-phase reciprocatory movement of the presser foot 18 and walking foot 20. Additional details of such a linkage assembly may be seen with reference to U.S. Pat. Nos. 4,449,464 and 5,309,854, hereby incorporated by reference herein as if fully set forth in their entirety.

With continued reference to FIGS. 3A-5B, an adjustment mechanism 120 is provided for selectably adjusting the linkage assembly 22 by an operator for purposes to be described below. The adjustment mechanism 120 has a lead screw 122 rotatably supported by a pair of end plates 124, 126. A matingly threaded block 128 is engaged by the lead screw 122. Rotation of adjustment knob 130 translates the block 128 fore and aft along a pair of guide rods 134, 136. A lock screw 140 in end plate 126 locks the lead screw 122 in place once the block is positioned by knob 130.

Block 128 includes a vertically oriented channel 142. Pin 84 has an end 144 that has a cross-section that mates with the cross-section of channel 144. Moving block 128 fore and aft translates channel 142 fore and aft which causes end 144 of pin 84 to translate fore and aft. To be able to travel fore and aft, end 144 of pin 84 must travel up and down in channel 142. (End 144 of pin 84 also travels up and down during articulation of linkage 22 caused by rotation of crank shaft 14.) Adjustment of lead screw 122 via knob 130 thus moves the center lines or pivot axes of pin 84 and second drive shaft 88 towards one another or away from one another. It is this selective adjustment of lead screw 122 via knob 130 that provides the first and second different stepping heights of the upper walking foot 20.

Figure 4A:
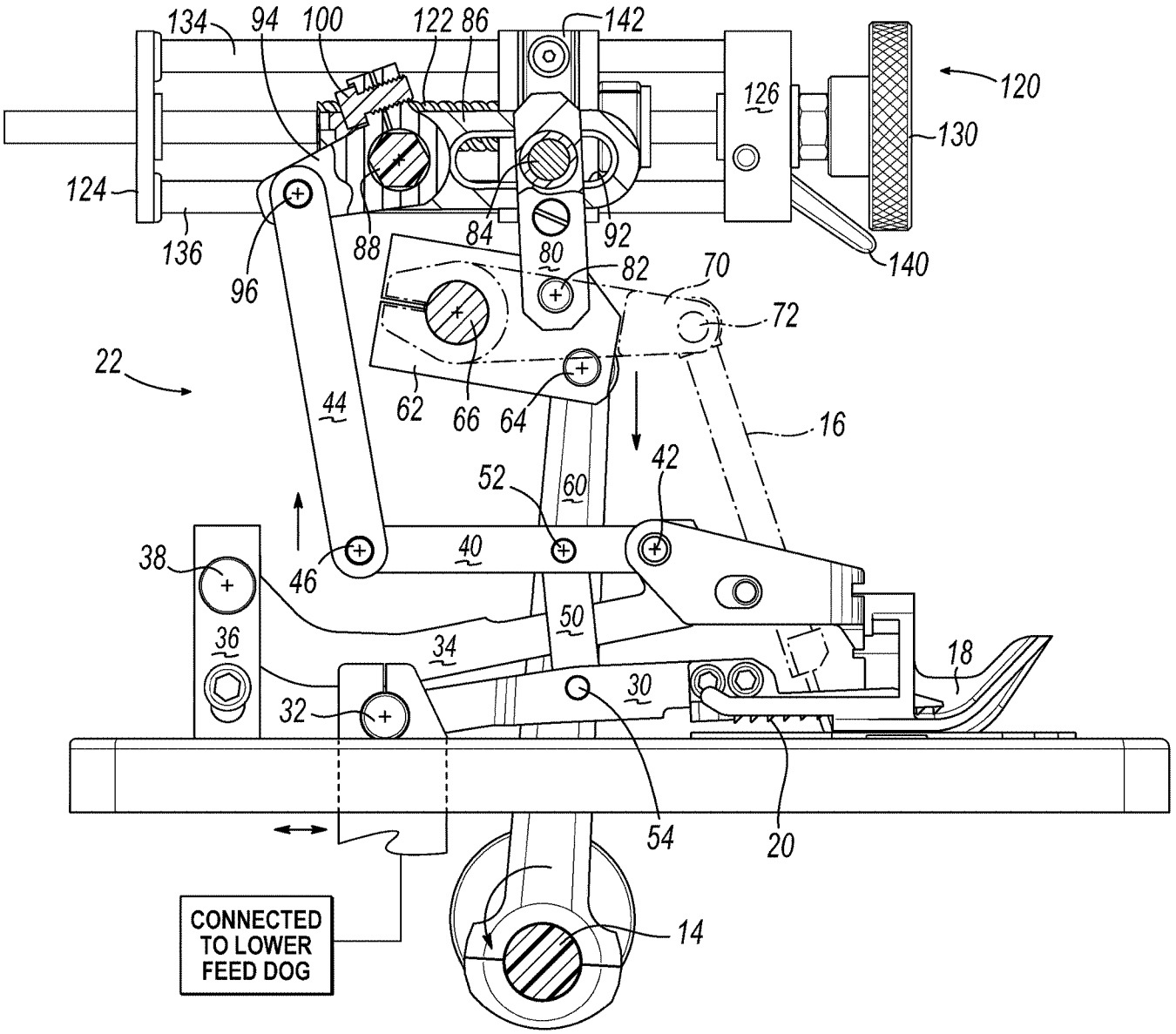
FIG. 4A is a right side view of the sewing machine of FIGS. 1 and 2 illustrating the needle assembly, presser foot, walking foot, linkage assembly, and adjustment mechanism, with the presser foot in the lowermost position and the walking foot in the uppermost position with the adjustment mechanism set for a low stepping height of the walking foot.
Figure 4B:
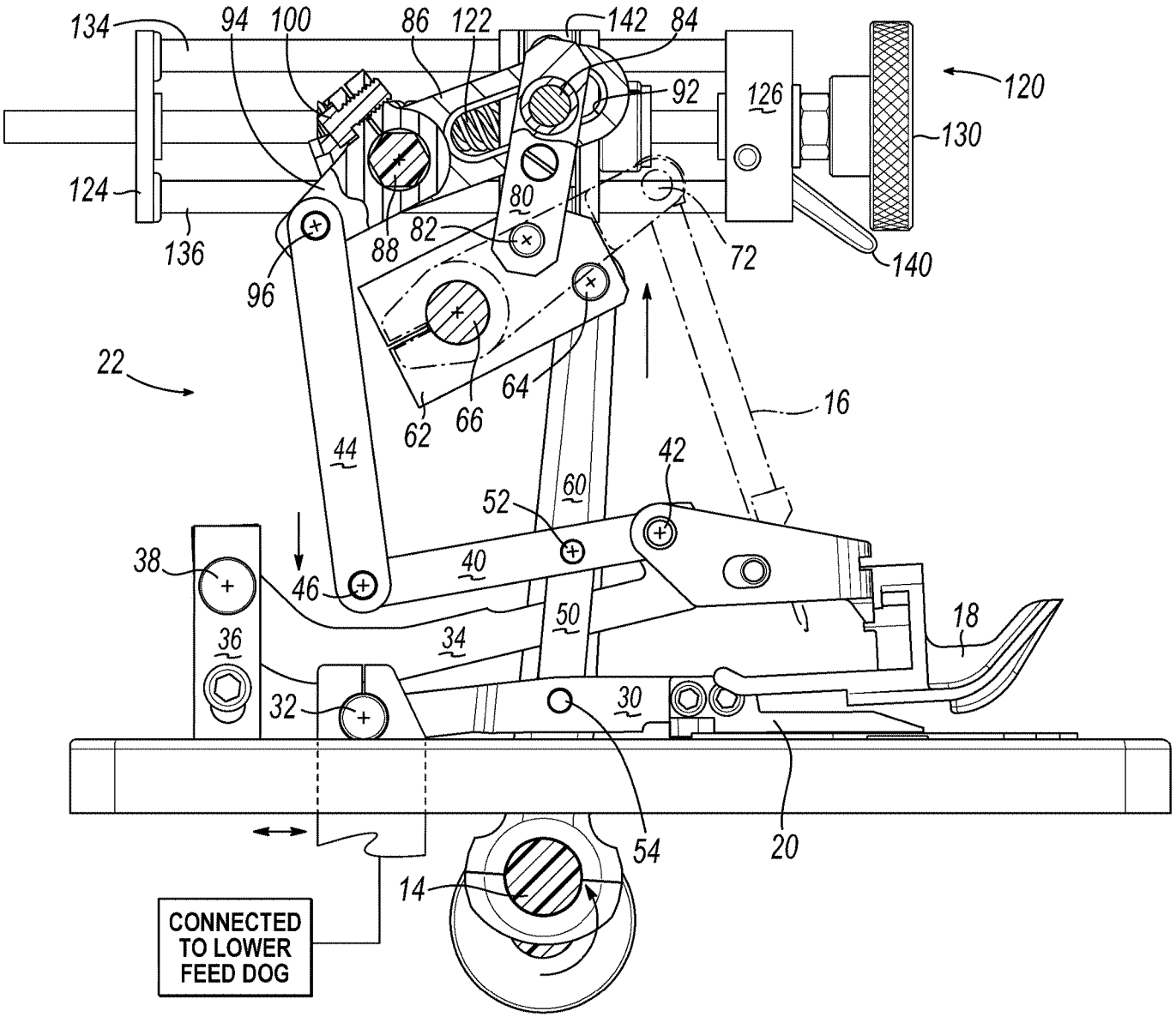
FIG. 4B is a view similar to FIG. 4A with the presser foot in the uppermost position and the walking foot in the lowermost position with the adjustment mechanism set for a low stepping height of the walking foot.

With reference to FIG. 4A, lead screw 122 has been adjusted via knob 130 to provide a low stepping height of upper walking foot 20. In this figure, the stepping foot 20 is at its upper limit of travel, and the presser foot 18 is at its lower limit of travel (material stitching positions of these elements). With reference to FIG. 4B, and with lead screw at the same adjustment position as in FIG. 4A, crank shaft 14 has rotated such that the stepping foot 20 is at its lower limit of travel, and the presser foot 18 is at its upper limit of travel (material feeding positions of these elements).

Figure 5A:
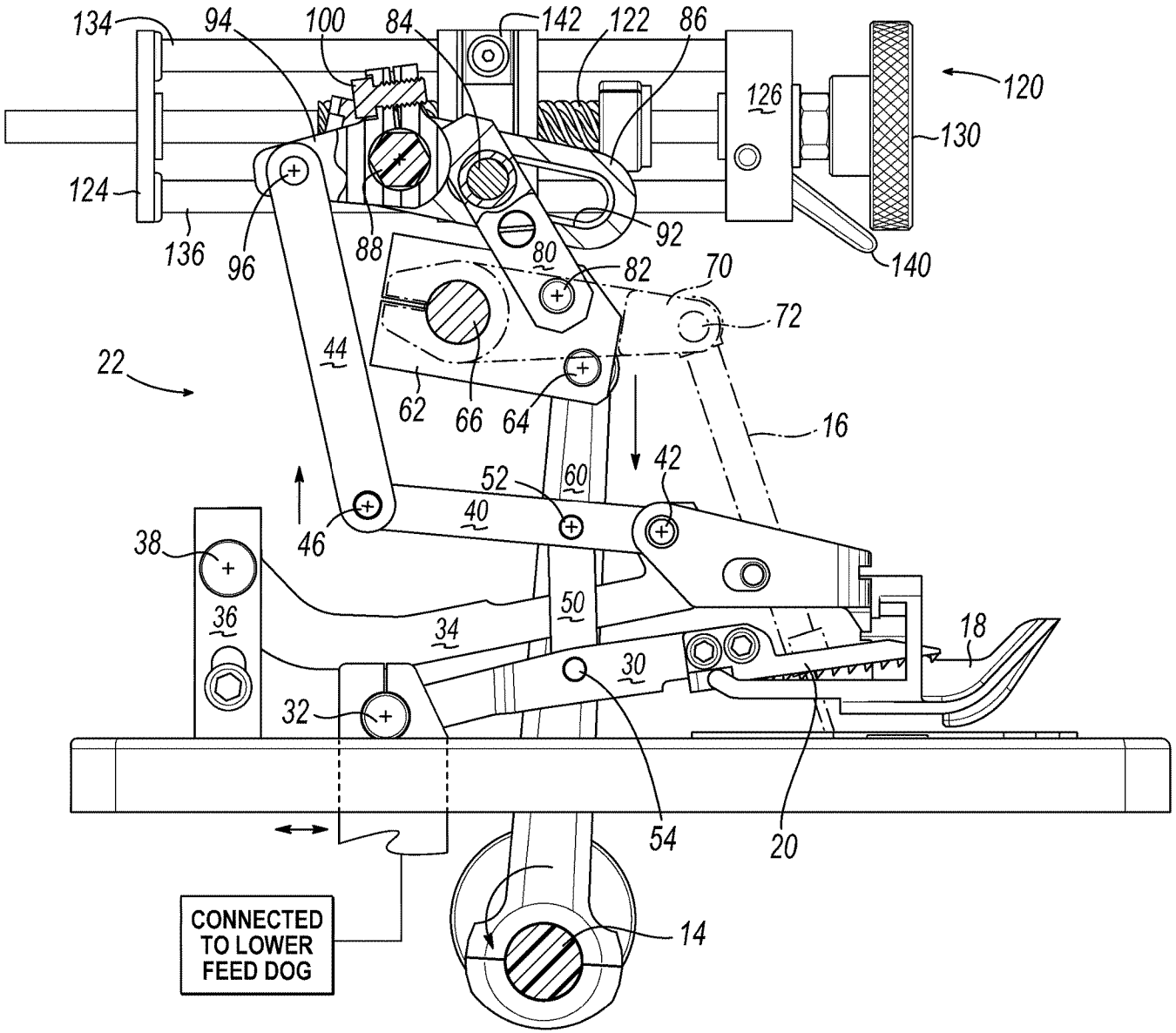
FIG. 5A is a view similar to FIG. 4A with the presser foot in the lowermost position and the walking foot in the uppermost position with the adjustment mechanism set for a high stepping height of the walking foot.
Figure 5B:
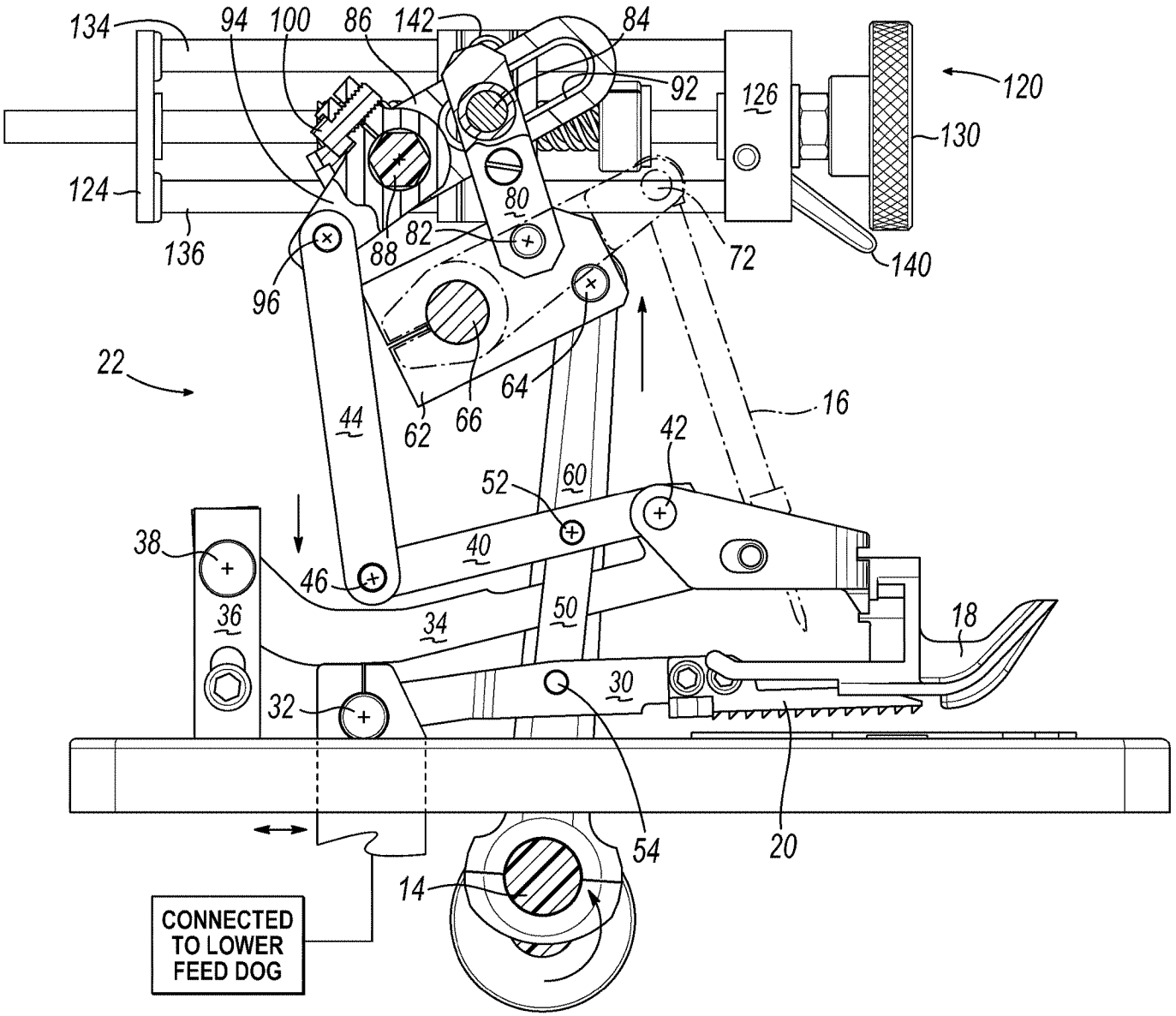
FIG. 5B is a view similar to FIG. 5A with the presser foot in the uppermost position and the walking foot in the lowermost position with the adjustment mechanism set for a high stepping height of the walking foot.

With reference to FIG. 5A, lead screw 122 has been adjusted via knob 130 to provide a high stepping height of upper walking foot 20. In this figure, the stepping foot 20 is at its upper limit of travel, and the presser foot 18 is at its lower limit of travel (material stitching positions elements). With reference to FIG. 5B, and with lead screw at the same adjustment position as in FIG. 5A, crank shaft 14 has rotated such that the stepping foot 20 is at its lower limit of travel, and the presser foot 18 is at its upper limit of travel (material feeding positions elements). Thus, the FIG. 5A positioned of presser foot 18 and stepping foot 20 can accommodate thicker material, such as shirred material.

It will be appreciated that, due to the nature of the lead screw 122 and block 128, the stepping height of the walking foot 20 is continuously or infinitely variable between the low stepping height (FIG. 4A) and the high stepping height (FIG. 5A).

Figure 6:
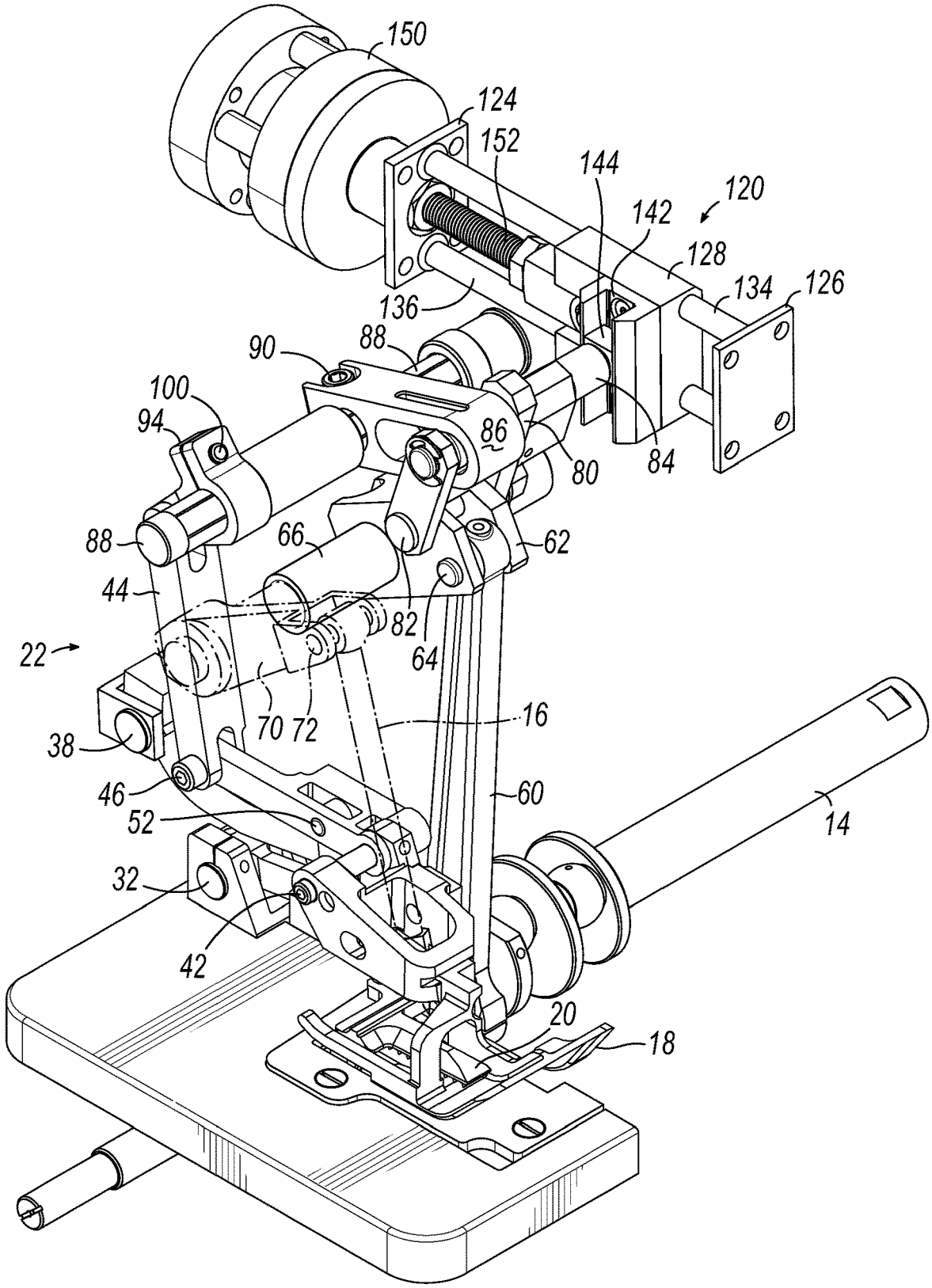
FIG. 6 is a view similar to FIG. 3A but with an alternative embodiment of the actuator for the adjustment mechanism.

While a lead screw has been shown and described as the actuator for moving the block 128 fore and aft, note that most any type of actuator could be used. For example, referring now to FIG. 6, and with like numbers representing like elements previously described, a pneumatic cylinder 150 can be used to translate block 128 fore and aft. Block 128 is connected to a rod 152 of the pneumatic cylinder 150. Thus, translation of rod 152 fore and aft translates block 128 fore and aft. In this embodiment, and unlike the previous embodiment utilizing a lead screw, the walking foot 20 has only two stepping height positions, i.e. the low stepping height and the high stepping height, due to the operation of the pneumatic cylinder 150.

Note further that other actuators could also be used, such as a hydraulic cylinder, an electric motor (linear or rotary), an electric solenoid, etc. All such actuators are deemed to be embraced by the term "actuator" used as part of an "adjustment mechanism", whether manually operated or powered by an external power source.

As used herein, the term "linkage" or "linkage assembly" shall be deemed to embrace an assemblage of multiple links having fixed and/or pivotal connections, as well as a single link or lever having fixed and/or pivotal connections at its opposite ends.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A sewing machine comprising:

a crank shaft, a first drive shaft, a second drive shaft, a needle assembly, a presser foot, and an upper walking foot, a first crank arm assembly connecting said crank shaft to said first drive shaft, a first linkage assembly connecting said first drive shaft to said needle assembly, a second crank arm assembly connecting said first drive shaft to said second drive shaft, and a second linkage assembly connecting said second drive shaft to said presser foot and said upper walking foot, said second linkage assembly configured to cause out-of-phase reciprocatory movement of said presser foot and said upper walking foot, said second crank arm assembly having a variable length selectably adjustable by an operator to yield at least first and second different stepping heights of said upper walking foot, wherein said first crank arm assembly includes a first crank arm and a first crank lever, said first crank arm pivoted at a first end to said crank shaft, said first crank lever fixedly secured at a first end to said first drive shaft, said first crank arm and said first crank lever pivotally connected at respective second ends.

2. The sewing machine of claim 1 wherein said variable length second crank arm also yields at least first and second different uppermost travel limits of said presser foot.

3. The sewing machine of claim 1 wherein said second crank arm assembly includes a second crank arm and a second crank lever, said second crank arm pivoted at a first end to said first crank lever, said second crank lever fixedly secured at a first end to said second drive shaft, said second crank arm and said second crank lever translationally and pivotally connected at respective second ends.

4. The sewing machine of claim 3 wherein one of said second crank arm and said second crank lever includes a pin and the other of said second crank arm and said second crank lever includes an elongated slot, said pin riding in said slot, and a position of said pin along a length of said slot selectably adjustable by an operator.

5. The sewing machine of claim 4 wherein said second crank arm includes said pin and said second crank lever includes said slot.

6. The sewing machine of claim 5 further including a lead screw selectably rotatable by an operator and configured to translate said pin along the length of said slot providing a low stepping height of said walking foot, a high stepping height of said walking foot, and a plurality of stepping heights between the low stepping height and the high stepping height.

7. The sewing machine of claim 6 wherein said lead screw includes a knob that is manually rotatable by an operator to rotate said lead screw.

8. The sewing machine of claim 7 wherein said lead screw includes a block that translates generally horizontally in response to rotation of said lead screw, an end of said pin rides in said block, and said second linkage assembly, said first crank arm assembly, and said second crank arm assembly are configured to cause said end of said pin to translate generally vertically in said block in response to said block translating generally horizontally, and in doing so to cause a distance between a center line of said second drive shaft and a center line of said pin to vary.

9. The sewing machine of claim 8 wherein said block includes a generally vertically extending channel and said end of said pin has a cross-section that mates with a cross-section of said channel.

10. The sewing machine of claim 5 further including a pneumatic cylinder actuatable by an operator and configured to translate said pin along the length of said slot providing a low stepping height of said walking foot and a high stepping height of said walking foot.

11. The sewing machine of claim 10 wherein said pneumatic cylinder includes a block that translates generally horizontally in response to translation of a piston rod of said pneumatic cylinder, an end of said pin rides in said block, and said second linkage assembly, said first crank arm assembly, and said second crank arm assembly are configured to cause said end of said pin to translate generally vertically in said block in response to said block translating generally horizontally, and in doing so to cause a distance between a center line of said second drive shaft and a center line of said pin to vary.

12. The sewing machine of claim 11 wherein said block includes a generally vertically extending channel and said end of said pin has a cross-section that mates with a cross-section of said channel.

13. The sewing machine of claim 11 wherein said block includes a generally vertically extending channel and said end of said pin has a cross-section that mates with a cross-section of said channel.

14. A sewing machine comprising:

a crank shaft, a drive shaft, a needle assembly, a presser foot, and an upper walking foot, a crank arm connecting said crank shaft to said drive shaft, a linkage assembly connecting said drive shaft to said needle assembly, said presser foot, and said upper walking foot, said linkage assembly configured to cause out-of-phase reciprocatory movement of said presser foot and said upper walking foot, and an adjustment mechanism selectably adjustable by an operator that varies a center line to center line distance between two pivot axes of said linkage assembly to yield at least first and second different stepping heights of said upper walking foot, wherein first and second links of said linkage mechanism are translationally and pivotally connected at respective ends to provide the variable center line to center line distance between the two pivot axes of said linkage assembly, wherein one of said first and second links includes a pin and the other of said first and second links includes an elongated slot, said pin riding in said slot, and a position of said pin along a length of said slot selectably adjustable by an operator.

15. The sewing machine of claim 14 further including a lead screw selectably rotatable by an operator and configured to translate said pin along the length of said slot providing a low stepping height of said walking foot, a high stepping height of said walking foot, and a plurality of stepping heights between the low stepping height and the high stepping height.

16. The sewing machine of claim 15 wherein said lead screw includes a knob that is manually rotatable by an operator to rotate said lead screw.

17. The sewing machine of claim 16 wherein said lead screw includes a block that translates generally horizontally in response to rotation of said lead screw, an end of said pin rides in said block, and said linkage assembly is configured to cause said end of said pin to translate generally vertically in said block in response to said block translating generally horizontally, and in doing so to cause the center line to center line distance between the two pivot axes of said linkage assembly to vary.

18. The sewing machine of claim 17 wherein said block includes a generally vertically extending channel and said end of said pin has a cross-section that mates with a cross-section of said channel.

19. The sewing machine of claim 14 further including a pneumatic cylinder actuatable by an operator and configured to translate said pin along the length of said slot providing a low stepping height of said walking foot and a high stepping height of said walking foot.

20. The sewing machine of claim 19 wherein said pneumatic cylinder includes a block that translates generally horizontally in response to translation of a piston rod of said pneumatic cylinder, an end of said pin rides in said block, and said linkage assembly is configured to cause said end of said pin to translate generally vertically in said block in response to said block translating generally horizontally.

* * * * *